US008614382B2

(12) United States Patent
Burgett et al.

(10) Patent No.: US 8,614,382 B2
(45) Date of Patent: Dec. 24, 2013

(54) DAMPER ACTION FOR UPRIGHT PIANO WITH SOSTENUTO SPRING TAB USING TENSION FROM THE DAMPER SPRING

(75) Inventors: Kirk Burgett, Sacramento, CA (US); Jamie Marks, Haverhill, MA (US); Dana Mazzaglia, Haverhill, MA (US)

(73) Assignee: Wessell, Nickel & Gross, Sacramento, CA (US)

( * ) Notice: Subject to any disclaimer, the term of this patent is extended or adjusted under 35 U.S.C. 154(b) by 0 days.

(21) Appl. No.: 13/426,353

(22) Filed: Mar. 21, 2012

(65) Prior Publication Data

US 2013/0247740 A1 Sep. 26, 2013

(51) Int. Cl.
*G10C 3/18* (2006.01)

(52) U.S. Cl.
USPC ..... 84/218; 84/240; 84/249

(58) Field of Classification Search
USPC ..... 84/218
See application file for complete search history.

(56) References Cited

U.S. PATENT DOCUMENTS 2,751,804 A * 6/1956 Comparetti ..... 84/255
4,161,129 A * 7/1979 Carbone ..... 84/253
5,022,302 A * 6/1991 Guyon ..... 84/255

* cited by examiner

*Primary Examiner* — Christopher Uhlir
(74) *Attorney, Agent, or Firm* — Craig A. Simmermon

(57) ABSTRACT

A damper action for an upright piano that comprises a springed tab on the damper lever that "ratchets" or gives way or folds away in one direction and does not in the other, to provide retention when the spring tab passes by the longitudinal ridge on the sostenuto rod in one direction and non-retention when the spring tab passes by the longitudinal ridge on the sostenuto rod the other direction. The ratchet aspect of the spring tab uses tension from the damper spring and does not require a separate spring to apply tension to yield the ratchet effect.

1 Claim, 15 Drawing Sheets

Prior Art

Prior Art

Prior Art

Prior Art

Prior Art

DAMPER ACTION FOR UPRIGHT PIANO WITH SOSTENUTO SPRING TAB USING TENSION FROM THE DAMPER SPRING

BACKGROUND OF THE INVENTION

1. Field of the Invention

This invention relates to the damper actions of upright pianos. A damper action is a mechanism that transmits motion from a piano key and/or motion from a piano pedal into motion of a damper resting on a piano string located inside the piano. In every piano, there is one damper action per piano key, where there are typically 88 piano keys in a piano. When a piano key is at rest, the corresponding damper of the corresponding damper action rests on or presses down onto the corresponding piano string(s), thereby preventing the string (s) from vibrating or making sound. When the piano key is depressed, the damper action causes the damper to lift off of the piano string(s), thereby allowing the string(s) to vibrate and to make sound. When the piano key is released, the damper action causes the damper to return to the rest position, pressing back onto the piano sting(s), thereby dampening the vibrations and eliminating the sound of the piano string(s). Alternately, damper actions may be actuated to lift dampers by depressing the sustain pedal or by depressing the sostenuto pedal of the piano. When the sustain pedal or the sostenuto pedal is depressed, one or more dampers is lifted from the piano strings to allow the strings to vibrate without dampening. When the sustain pedal or the sostenuto pedal is released, the damper is returned to the rest position to press down onto the piano strings dampening the sound therefrom. This invention specifically relates to one subcomponent of a damper action, namely the sostenuto tab or sostenuto lip located on the damper lever.

2. Description of Related Art

A damper action comprises: a damper lever, a damper spring, a damper wire, and a damper. A damper action cycles with a key depression, a sustain pedal depression, or a sostenuto pedal depression, where each causes the damper lever to rotate, to move the damper wire attached to one end of the damper lever, which rotates the damper attached to the other end of the damper wire. This causes the damper to be lifted away from the piano strings to allow vibrations and sounds to sustain on the piano strings without dampening by the damper. When the key, sustain pedal, or sostenuto pedal is released, the damper lever returns to the rest position thereby returning the damper to press back against the piano strings. The damper spring puts tension on the damper lever to cause the damper to press against the piano strings when the damper action is at rest. Thus, the damper spring causes the damper to return to the rest position on the piano strings when the piano key is released.

There are three possible ways to actuate a damper action: key depression, sustain pedal depression, and sostenuto pedal depression.

When a piano key is depressed, this causes rotation of the corresponding damper lever, which removes the correspond damper from the corresponding piano strings. When the key is released, the damper lever cycles back to cause the damper to rest back on the piano strings. Thus, one key depression actuates one damper action.

When the sustain pedal is depressed, this causes a sustain lifter rod to rotate, which causes all 88 damper levers in the piano to rotate, thereby removing all 88 dampers from the piano strings. Thus, one sustain pedal depression actuates all 88 damper actions.

When the sostenuto pedal is depressed, this causes all damper actions already actuated from key depression at the time the sostenuto pedal was depressed, to remain detached from the piano strings, even after the formerly depressed keys are released, as long as the sostenuto pedal is held depressed. Depressing the sostenuto pedal allows piano stings to continue to make sound after the corresponding keys are released and to continue to do so until the sostenuto pedal is released. Thus, the sostenuto pedal suspends the return of certain dampers until the sostenuto pedal is released. When the sostenuto pedal is released, the respective dampers return to press back against the piano strings and to dampen the sound produced therefrom.

As discussed in detail below, when the sostenuto pedal is depressed, this causes a sostenuto rod to rotate. When the sostenuto rod rotates, a longitudinal ridge on the sostenuto rod aligns with a tab on the damper levers, to prevent the damper levers from rotating back to the rest position after the key is released.

A problem arises at this point regarding the ability to play other piano keys while holding the sostenuto pedal in the depressed position. As discussed in detail below, depressing a key and actuating a damper action while the sostenuto pedal is depressed causes the tab on the corresponding damper lever to interfere with the longitudinal ridge on the sostenuto rod to produce a clicking sound from the two parts contacting each other, or, even worse, to disrupt the tone of the strings from erratic damper movement caused by the two parts colliding with each other. Thus, there is a problem playing other piano keys while holding the sostenuto pedal down.

The same problem arises when the sostenuto pedal is released. If a key is depresses just as the sostenuto pedal is released, this also causes the tab on the corresponding damper lever to interfere with the longitudinal ridge on the sostenuto rod to produce a clicking sound from the two parts contacting each other, or, even worse, to disrupt the tone of the strings with erratic damper movement caused by the two parts colliding with each other. Similarly, when the sostenuto pedal is released while holding down later depressed keys, the longitudinal ridge on the sostenuto rod interferes with the tab on the corresponding damper lever to produce a clicking sound from the two parts contacting each other or even worse to disrupt the tone of the strings from erratic damper movement caused by the two parts colliding with each other. Thus, there is a problem releasing the sostenuto pedal while play or holding other piano keys.

To remedy these problems, this invention provides a spring tab on the damper lever that "ratchets" or gives way or folds away in one direction and does not in the other, to provide retention when the spring tab passes by the longitudinal ridge on the sostenuto rod in one direction and non-retention when the spring tab passes by the longitudinal ridge on the sostenuto rod the other direction. Further, as discussed below, the ratchet aspect of the spring tab uses tension from the damper spring and does not require a separate spring to apply tension to yield the ratchet effect.

There are no upright piano damper actions in the prior art with spring tabs on the damper levers. There are no upright piano damper actions in the prior art with ratcheted tabs on the damper levers that hold tension from the existing damper spring of the damper action.

BRIEF SUMMARY OF THE INVENTION

It is an aspect of this invention to provide a damper action for an upright piano that allows the playing of piano notes by striking piano keys after the sostenuto pedal has been depressed and before it is released, without causing a clicking sound or other unwanted sound originating from any contact between the longitudinal ridge on the sostenuto rod and the tab on the damper levers corresponding to stricken keys.

It is an aspect of this invention to provide a damper action for an upright piano that allows the playing of piano notes by striking piano keys after the sostenuto pedal has been depressed and before it is released, without causing a change or disruption in piano tone or sound originating from any contact between the longitudinal ridge on the sostenuto rod and the tab on the damper levers corresponding to stricken keys.

It is an aspect of this invention to provide a damper action for an upright piano that allows the playing of piano notes by striking piano keys at the same time that the sostenuto pedal is released without causing a clicking sound or other unwanted sound originating from any contact between the longitudinal ridge on the sostenuto rod and the tab on the damper levers corresponding to stricken keys.

It is an aspect of this invention to provide a damper action for an upright piano that allows the playing of piano notes by striking piano keys at the same time that the sostenuto pedal is released without causing a change or disruption in piano tone or sound originating from any contact between the longitudinal ridge on the sostenuto rod and the tab on the damper levers corresponding to stricken keys.

DEFINITION LIST

Figure 1:
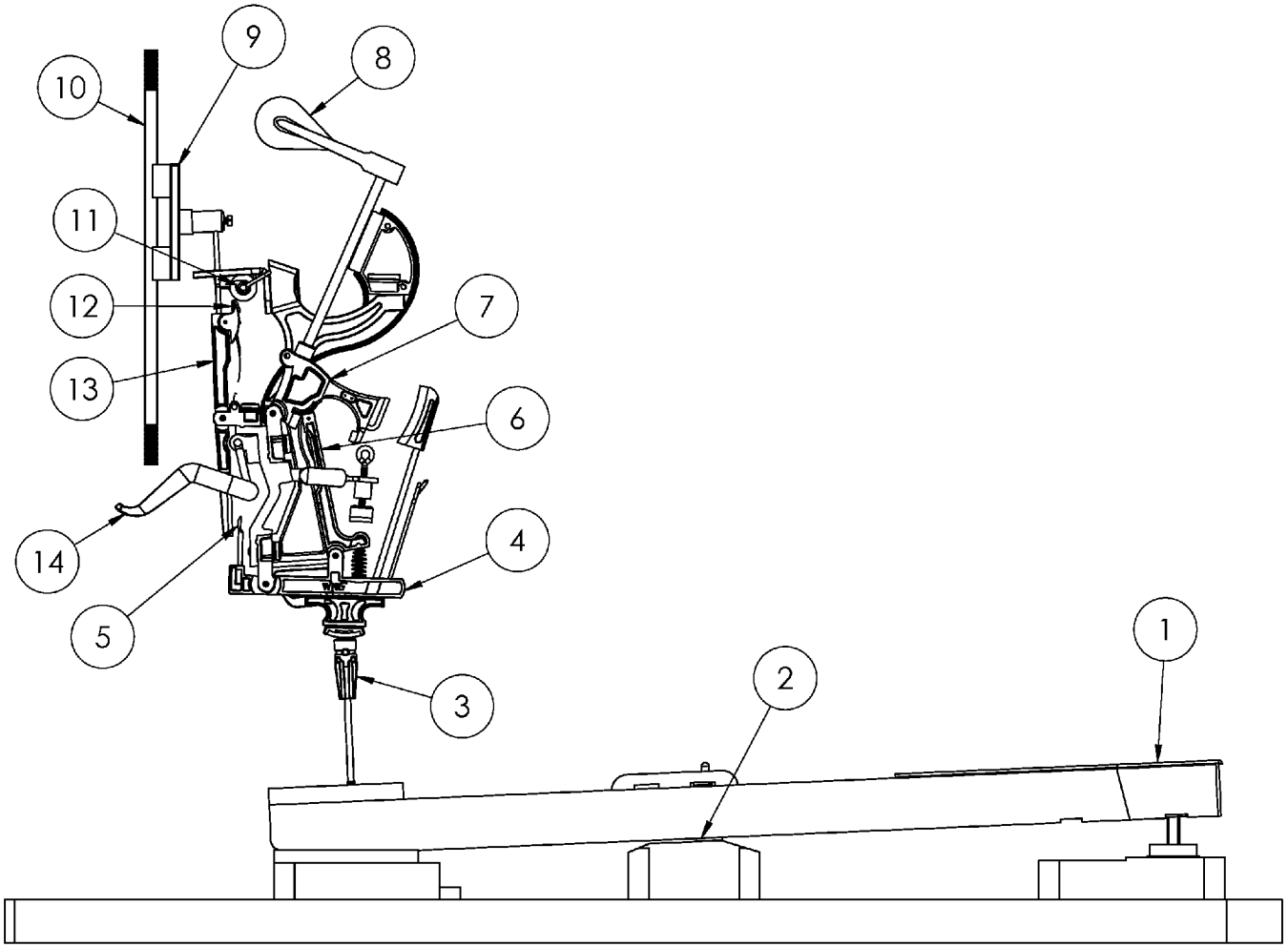
FIG. 1 is a side elevation view of a piano key, a piano action, a damper action, and a piano string of an upright piano with sostenuto spring tab, with piano key at rest.

| Term | Definition |
|---|---|
| 1 | Piano Key |
| 2 | Balance Point of Piano Key |
| 3 | Dowel Capstan |
| 4 | Whippen |
| 5 | Damper Spoon |
| 6 | Jack |
| 7 | Hammer Butt |
| 8 | Hammer |
| 9 | Damper |
| 10 | Piano String |
| 11 | Sostenuto Rod |
| 12 | Sostenuto Spring Tab |
| 13 | Damper Lever |
| 14 | Sustain Lifter Rod |
| 15 | Rigid Sostenuto Tab (Prior Art) |
| 16 | Damper Flange |
| 17 | Damper Spring |
| 18 | Sostenuto Spring Tab Center of Rotation |
| 19 | Engagement Tip of Sostenuto Spring Tab |
| 20 | Sostenuto Bracket |

DETAILED DESCRIPTION OF THE INVENTION

An upright piano damper action comprises: a damper lever 13, a damper spring 17, a damper wire (depicted, not numbered), and a damper 9. A damper action cycles with a key 1 depression, a sustain pedal (not depicted) depression, or a sostenuto pedal (not depicted) depression, where each causes the damper lever 13 to rotate. Damper lever 13 is a rigid oblong member with two ends. Damper lever 13 rotation occurs about center-of-rotation point 18 which is located near the center of damper lever 13. When a damper action is at rest, damper 9 rests against or presses against piano string 10 to dampen any vibrations or sounds in the piano string. Thus, when at rest, a damper action dampens the piano string. When a key, sustain pedal, or sostenuto pedal is depressed, the upper end of damper lever 13 rotates away from piano string 10 to become detached therefrom thereby removing any vibration or sound dampening effects on the piano string 10. When a key, sustain pedal, or sostenuto pedal is released, the upper end of damper lever 13 rotates back towards piano string 10 to rest or push slightly there against thereby reestablishing the vibration or sound dampening effects on the piano string 10.

Damper spring 17 puts tension on damper lever 13 to cause damper 9 to press against piano string 10 when the damper action is at rest. Thus, damper spring 17 causes damper 9 to return to the rest position on the piano strings when the piano key, the sustain pedal, and/or the sostenuto pedal is released. Damper spring 17 is a spring that exerts tension on the upper end of damper lever 13. Damper spring 17 presses on one end against damper flange 16 which is connected to a rigid piano rail and thus this end of damper spring 17 remains stationary and fixed in location. The other end of damper spring 17 exerts tension against the upper end of damper lever 13. Since damper lever 13 is a rotating member, it is pushed by spring tension against piano string 10.

Figure 2:
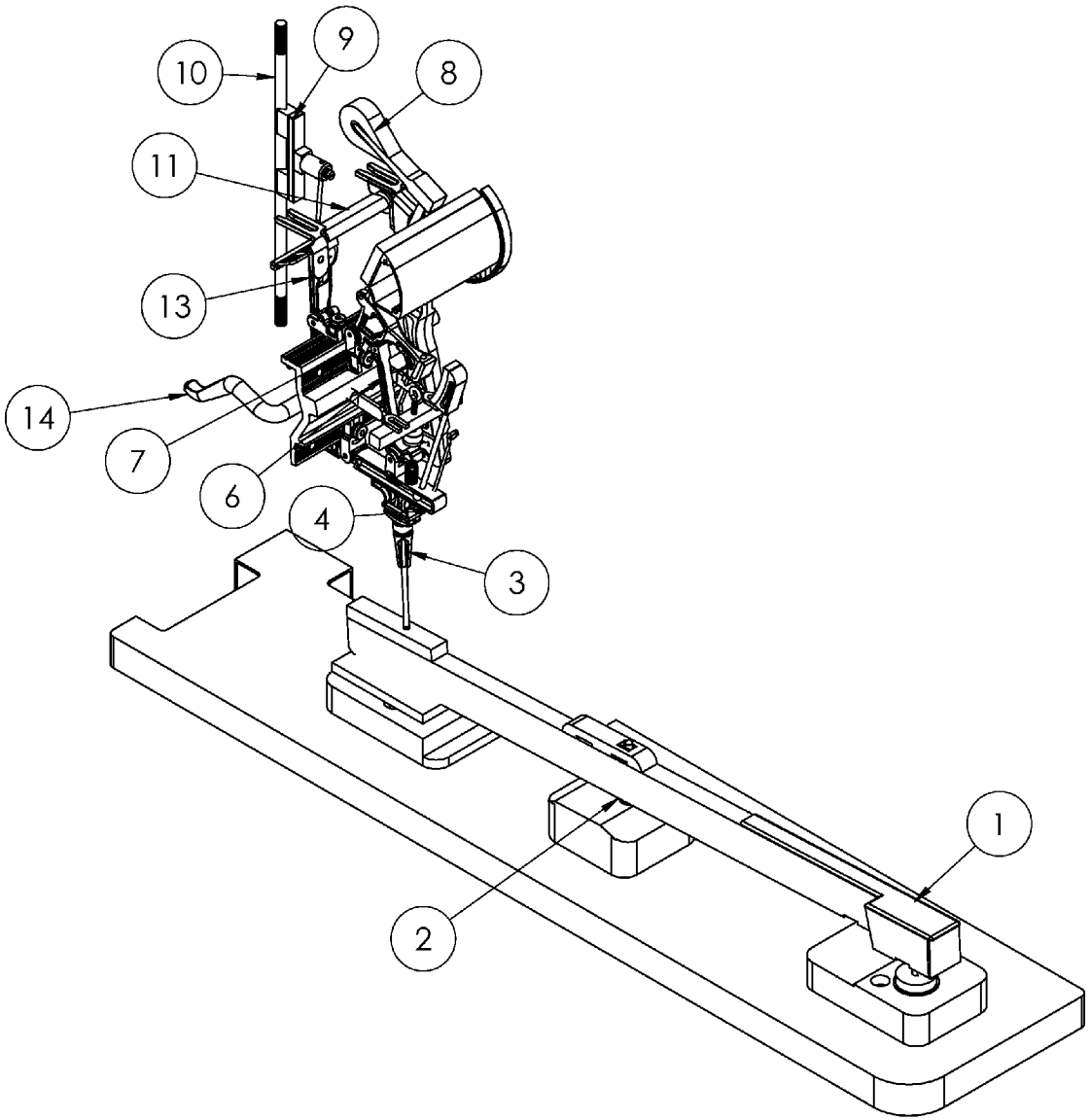
FIG. 2 is a prospective view of a piano key, a piano action, a damper action, and a piano string of an upright piano with sostenuto spring tab with piano key at rest.

In FIGS. 1 and 2, piano key 10 is at rest. In this condition, damper spring 17 pushes damper 9 in a counterclockwise direction against piano string 10.

Figure 3:
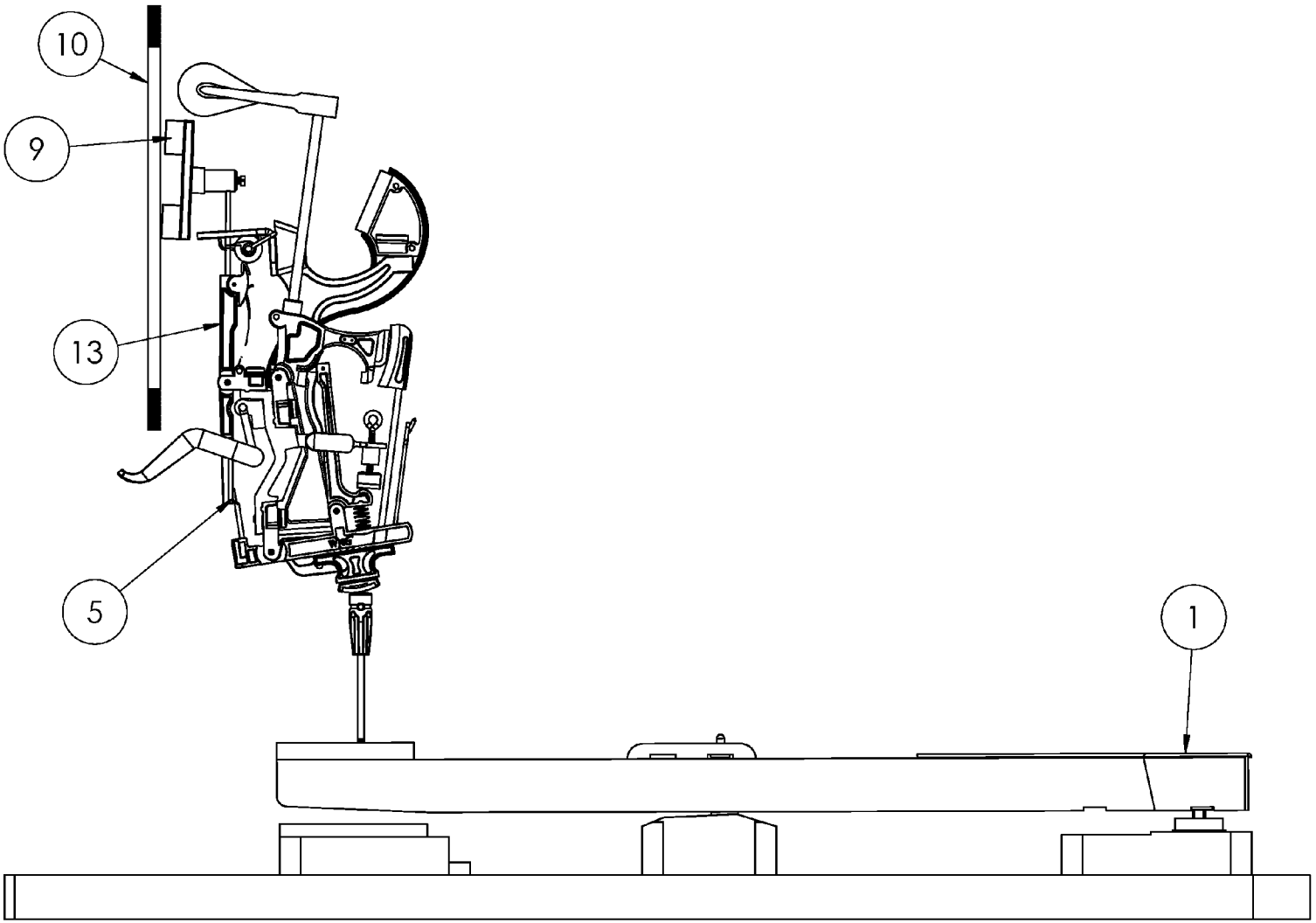
FIG. 3 is a snapshot of FIG. 1 with piano key fully depressed.

FIG. 3 depicts how a piano key actuates the damper action. The depression of piano key 1 causes the piano action to cycle, which causes the damper spoon 5 to rotate in a counterclockwise direction, to contact the lower end of damper lever 13, thereby causing damper lever 13 to rotate in a clockwise direction, thereby removing damper 9 from pressing against piano string 10. During this motion, the piano action also caused hammer 8 to strike piano string 10 to instill vibrations and sound going un-dampened because the damper is removed from the string. String 10 remains un-dampened at this point until the piano key 1 is released.

Figure 4:
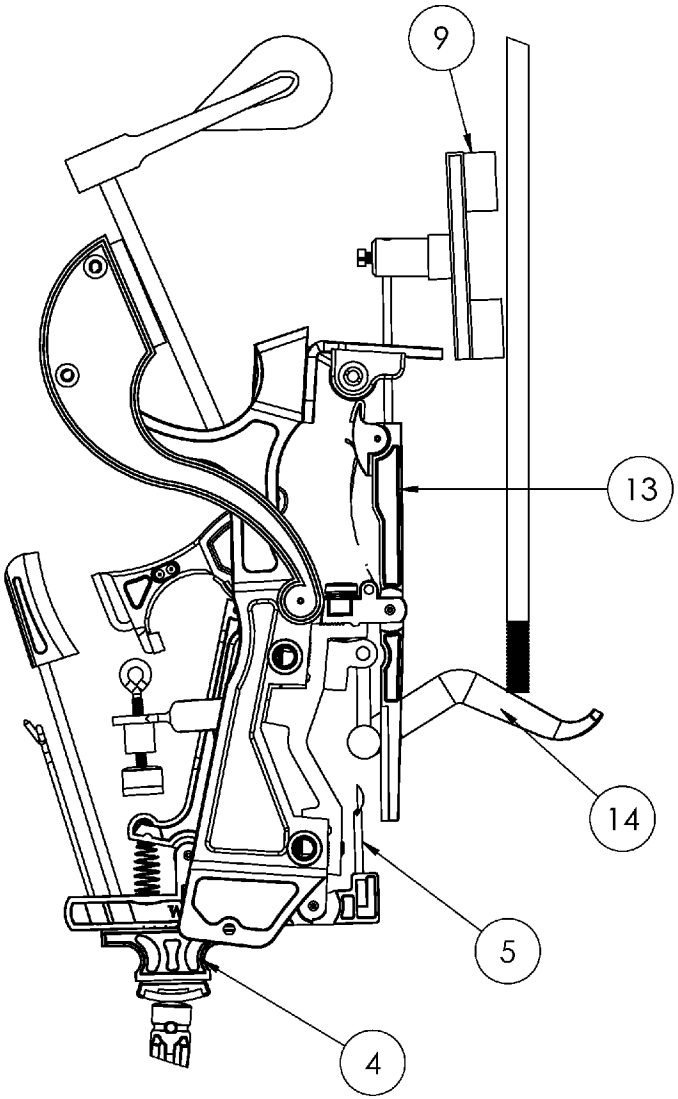
FIG. 4 is a snapshot of FIG. 1 with sustain pedal fully depressed.

FIG. 4 depicts how the sustain pedal actuates the damper action. The depression of the sustain pedal causes sustain lifter rod 14 to rotate in a counterclockwise direction and to move towards piano string 10, which causes sustain lifter rod to contact the lower end of damper lever 13. This motion causes damper lever 13 to rotate in the clockwise direction in FIG. 4. Sustain lifter rod 14 is a long rod, rail, or track positioned parallel to the piano keyboard running the full width of the piano. When lifter rod 14 rotates and moves, it pushes on all 88 damper levers 13 in order to remove all dampers 9 from all piano stings 1 in the piano. When the sustain pedal is released, sustain lifter rod 14 rotates back in a clockwise direction and moves way from the lower ends of damper levers 14, thereby allowing tension from all damper springs 17 to push all dampers 9 back against piano strings 1.

Figure 5:
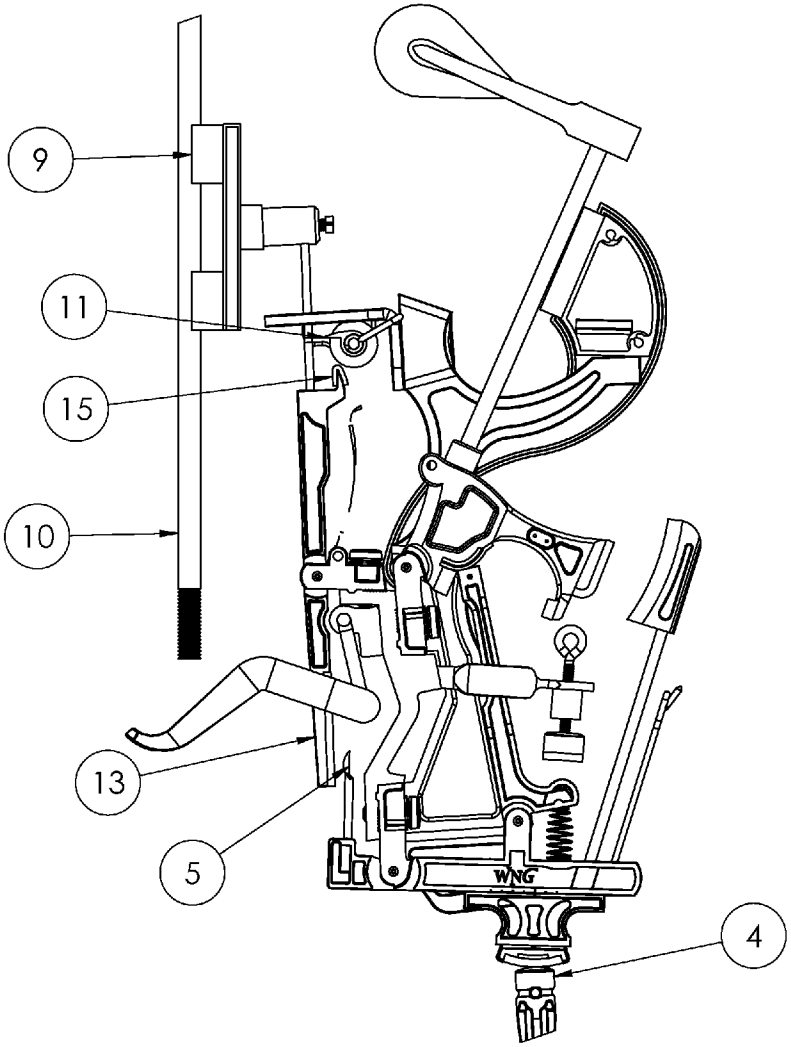
FIG. 5 is a side elevation view of a piano key, a piano action, a damper action, and a piano string of an upright piano of the Prior Art without sostenuto spring tab, with piano key at rest.
Figure 6:
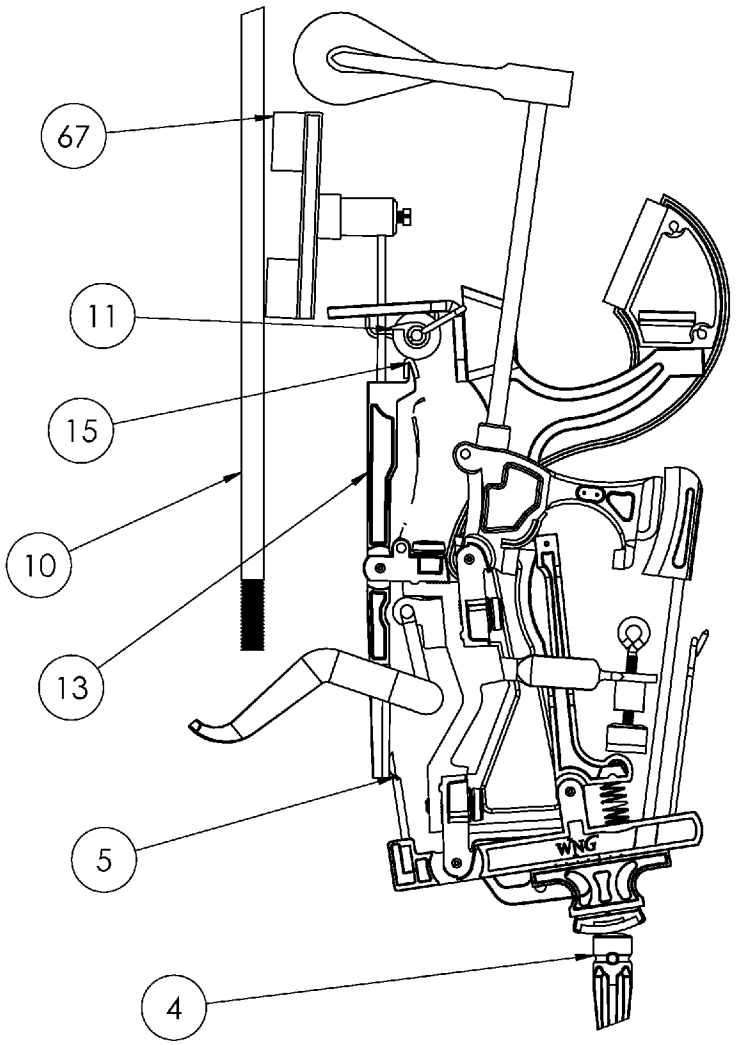
FIG. 6 is a snapshot of FIG. 5 with piano key fully depressed.

FIGS. 5-9 depict how the sostenuto pedal actuates one or more damper actions with prior art upright piano damper actions. FIG. 5 depicts piano key 1 at rest with damper action at rest. FIG. 6 depicts piano key 1 fully depressed, so that damper spoon 5 contacts the lower end of damper lever 13 to rotate this member in the clockwise direction, to lift damper 9 from piano string 10. In this state, lush sustaining sound may be achieved without sound dampening from the damper action. Dampening reverts however to return the damper as according to FIG. 5 upon the release of depressed piano key 1.

Figure 7:
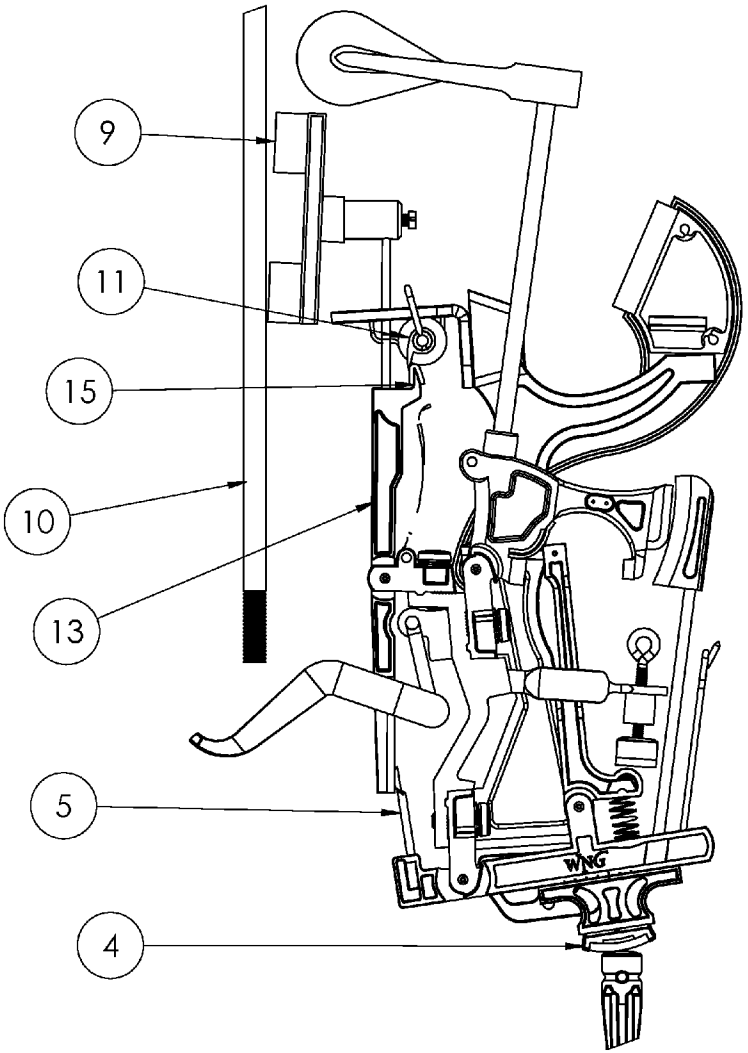
FIG. 7 is a snapshot of FIG. 6 with sostenuto pedal fully depressed.
Figure 8:
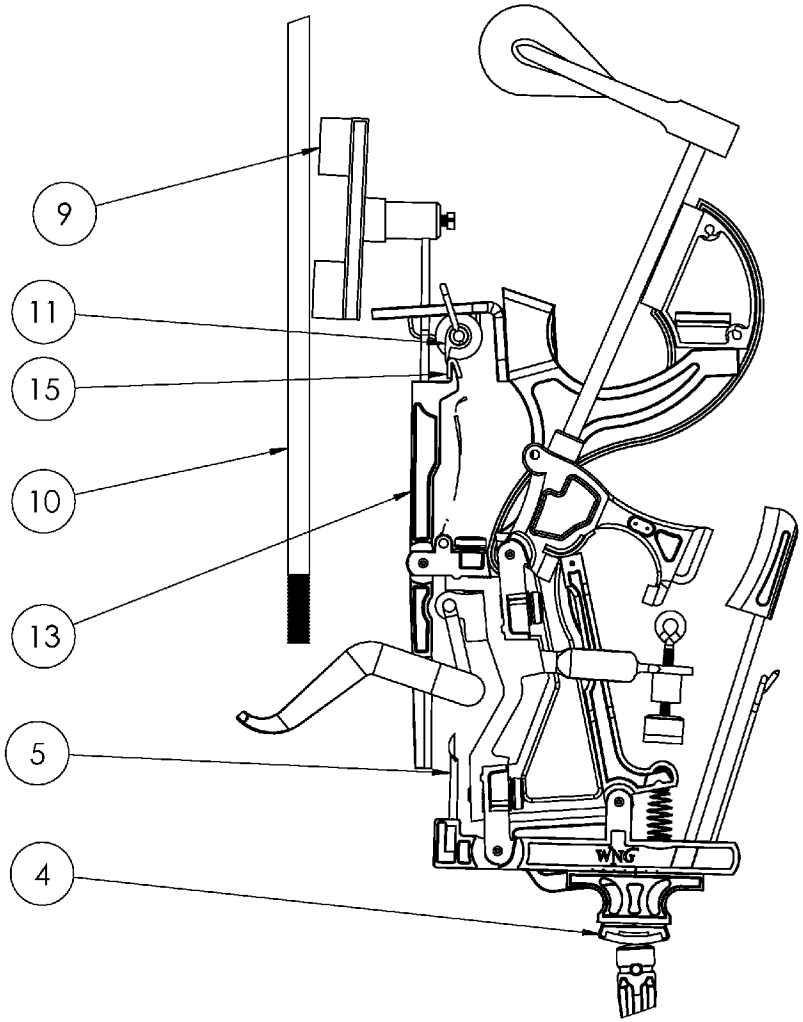
FIG. 8 is a snapshot of FIG. 7 with piano key released and sostenuto pedal fully depressed.
Figure 9:
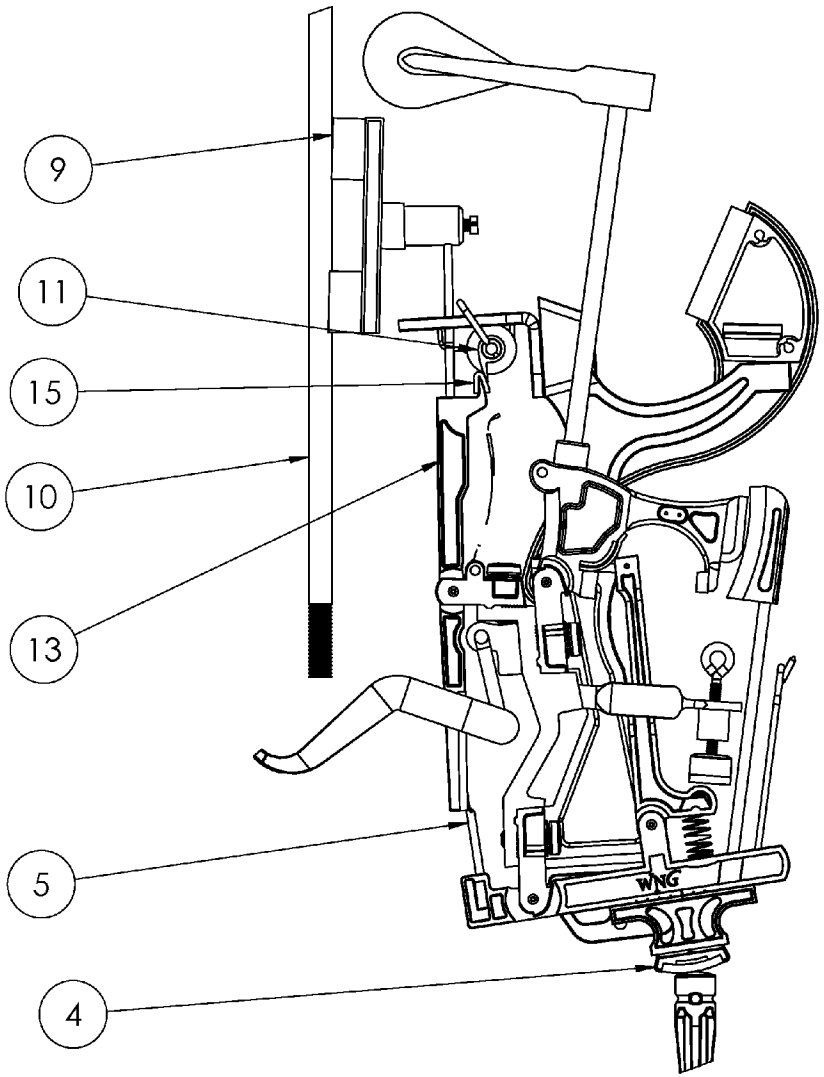
FIG. 9 is a side elevation view of different piano key, piano action, damper action, and piano string of the same piano as FIG. 8, with its key fully depressed after holding down the sostenuto pedal where the interference between longitudinal ridge and damper lever tabs can be noted.

Before the returning to the FIG. 5 dampened state, however, the pianist may wish to sustain these already depressed notes and then move on to playing other notes without such sustain. FIGS. 7-9 depict this state of affairs.

FIG. 7 depicts the rotation of sostenuto rod 11 in response to depression of the sostenuto pedal. The depression of the sustain pedal causes sostenuto rod 11 to rotate in a counterclockwise direction. The longitudinal axis of sostenuto rod 11 runs perpendicular to the pages of all figures except FIG. 2. Sostenuto lifter rod 11 is a long rod, rail, or track positioned parallel to the piano keyboard running the full width of the piano. Sostenuto rod 11 comprises a longitudinal ridge on the exterior running along the length of the rod. Longitudinal ridge rotates when sostenuto rod 11 rotates. When sostenuto pedal is at rest, longitudinal ridge is positioned as depicted in FIGS. 5-6, at the nine o'clock location. When sostenuto pedal is fully depressed, longitudinal ridge is positioned as depicted in FIGS. 7-9, at the six o'clock location. As depicted, longitudinal ridge rotates about a quarter turn in response to sostenuto pedal depression.

In FIG. 8, piano key 1 has been released while holding the sostenuto pedal depressed. This cases damper spoon 5 to move in the rightward direction, thereby releasing pressure on the lower end of damper lever 13, causing damper spring 17 to exert pressure on the upper end of damper lever 13 in the counterclockwise direction. Normally this would return damper 9 to rest upon piano string 10. However, damper 9 does not return to rest upon piano string 10 because of the pressure exerted on the sostenuto pedal, translating to pressure on rigid tabs 15. Damper 9 would return but for rigid tab 15 snared against the longitudinal ridge of sostenuto rod 11. Thus, the sostenuto pedal actuates the damper action to hold damper 9 away from piano string 10 until the pedal is released.

The nature of the problem with the prior art is depicted in FIG. 9. While the sostenuto pedal is depressed and thus while longitudinal ridge is at the six o'clock position, when new piano keys 1 or new piano notes are played, the piano action still actuates the damper action. Thus, damper spoon 5 moves leftward to contact the lower end of damper lever 13, to rotate the member, causing rigid tab 15 to crash into the longitudinal ridge of sostenuto rod. This collision is a problem for most pianists.

Figure 10:
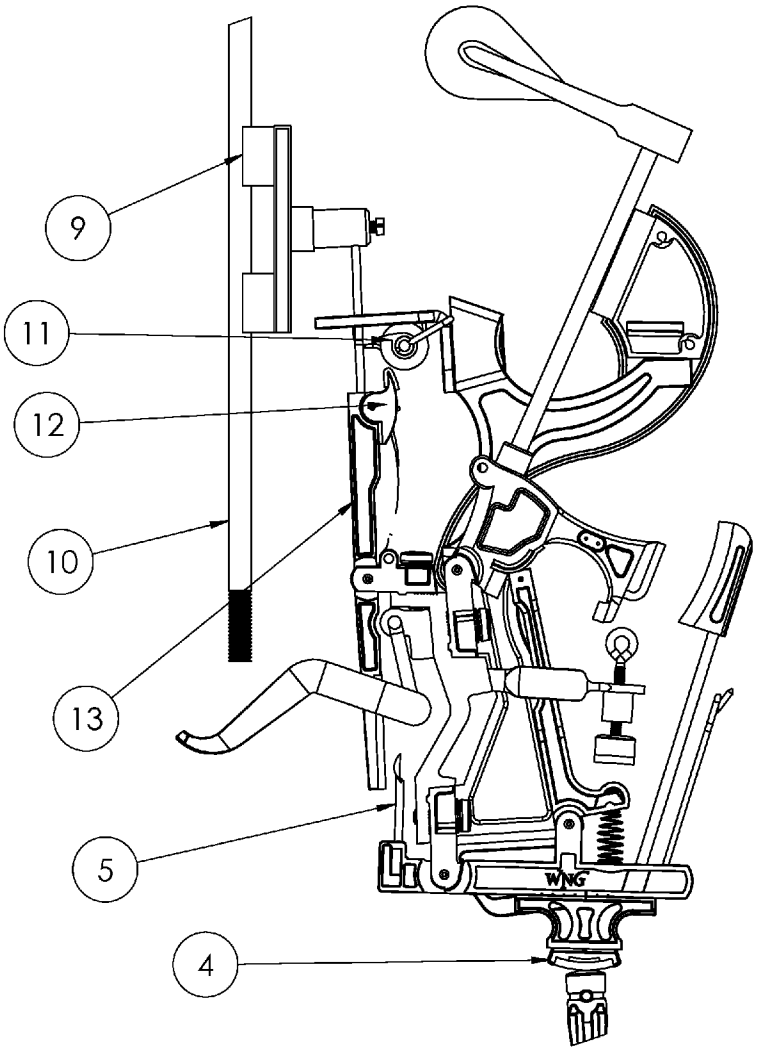
FIG. 10 is a side elevation view of a piano key, a piano action, a piano string, and a damper action with sostenuto spring tab of an upright piano, with piano key at rest.
Figure 11:
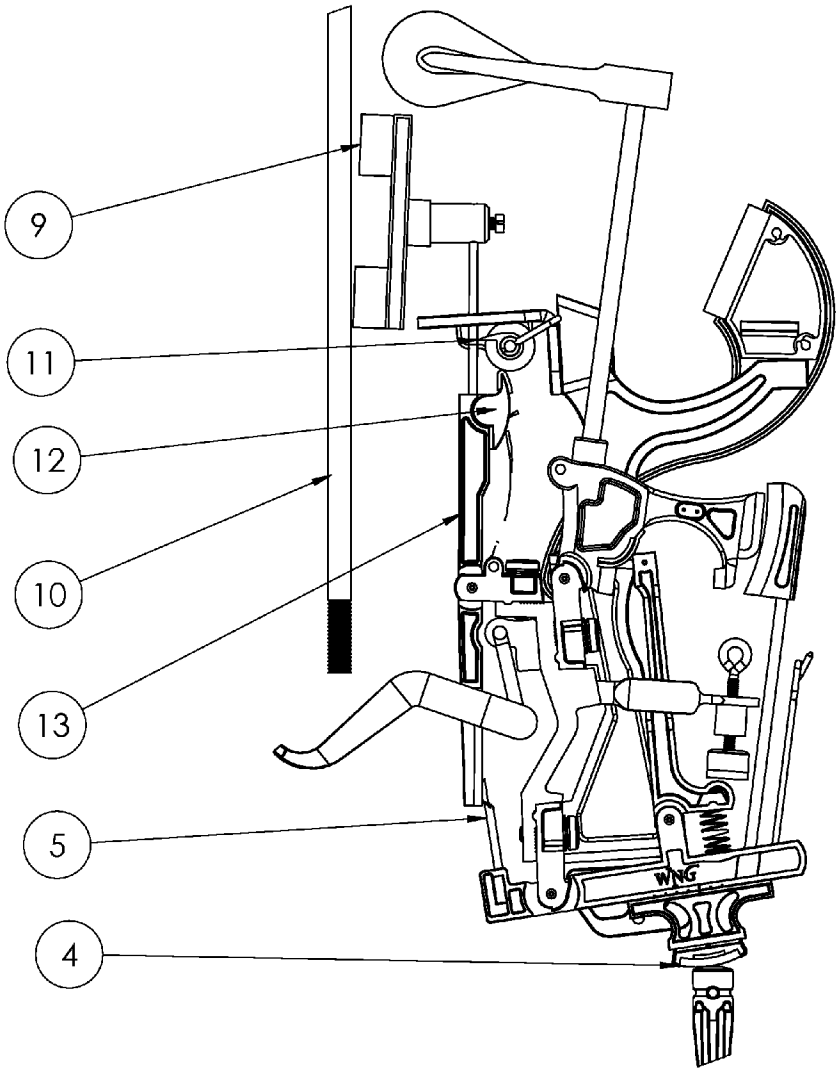
FIG. 11 is a snapshot of FIG. 10 with piano key fully depressed.

FIGS. 10-15 depict how this collision does not occur using sostenuto spring tab 12 using tension from the damper spring 17. FIG. 10 depicts piano key 1 at rest with damper action at rest. FIG. 11 depicts piano key 1 fully depressed, so that damper spoon 5 contacts the lower end of damper lever 13 to rotate this member in the clockwise direction, to lift damper 9 from piano string 10. In this state, lush sustaining sound may be achieved without sound dampening from the damper action. Dampening reverts however to return the damper as according to FIG. 10 upon the release of depressed piano key 1.

Figure 12:
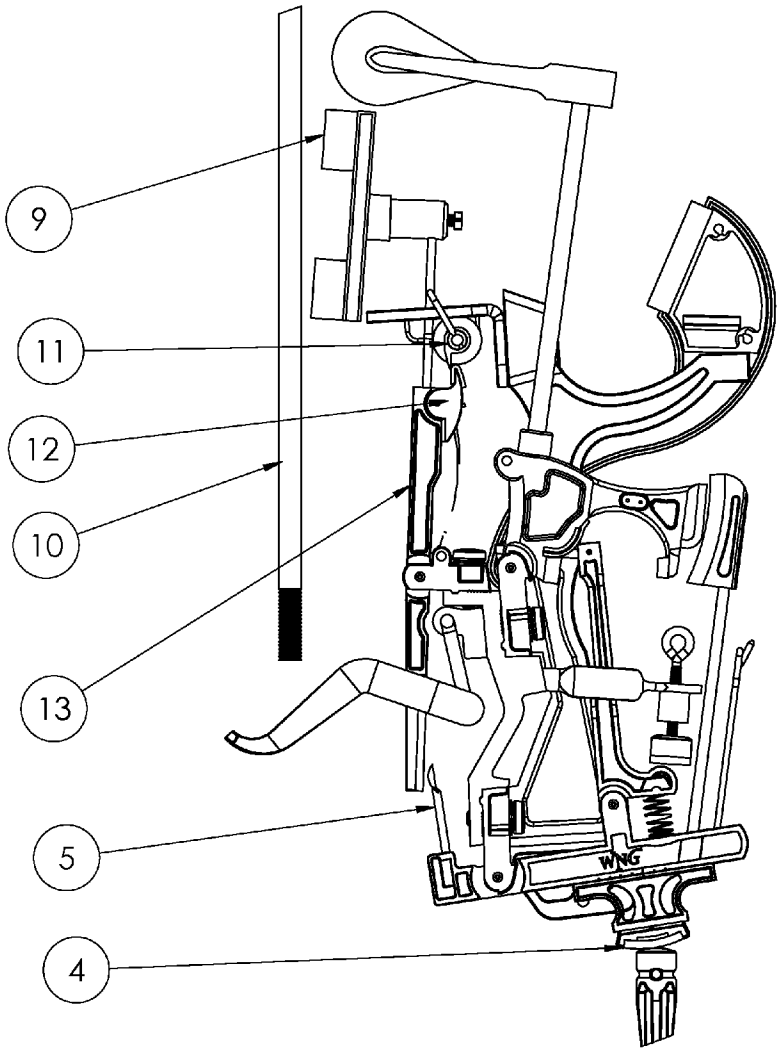
FIG. 12 is a snapshot of FIG. 11 with sostenuto pedal fully depressed.
Figure 13:
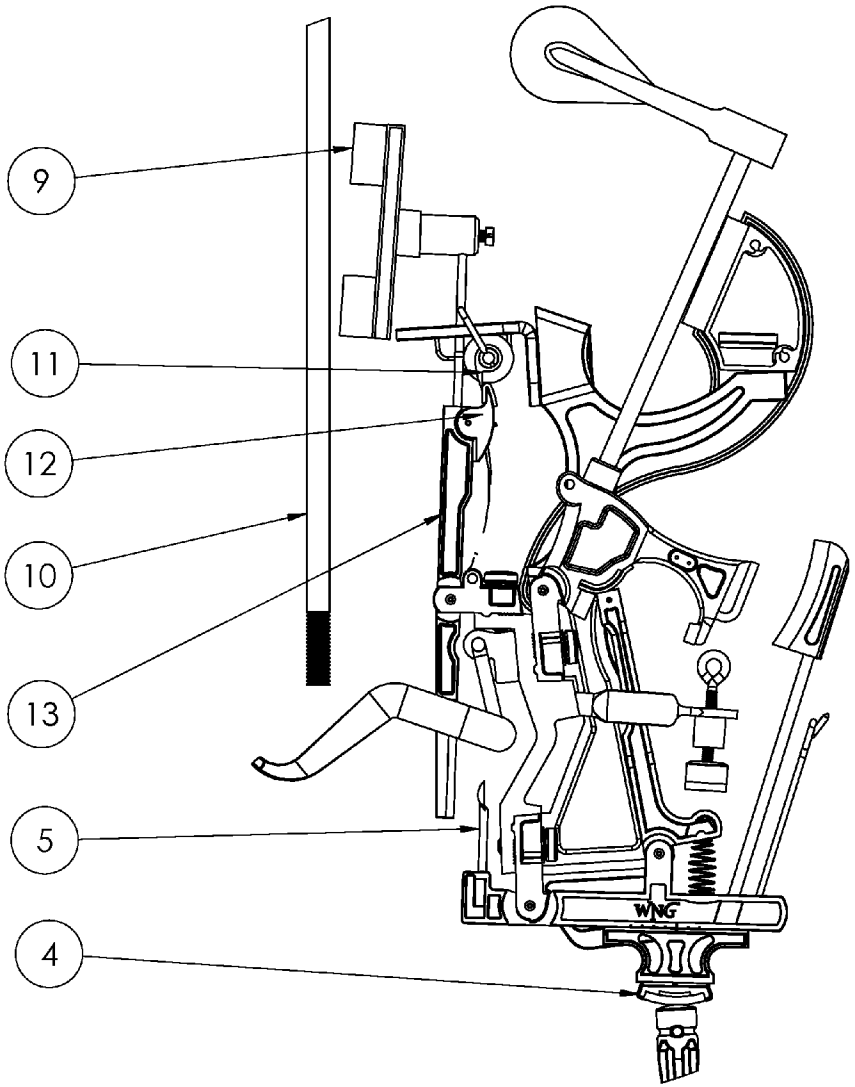
FIG. 13 is a snap shot of FIG. 12 with piano key released and sostenuto pedal fully depressed.
Figure 14:
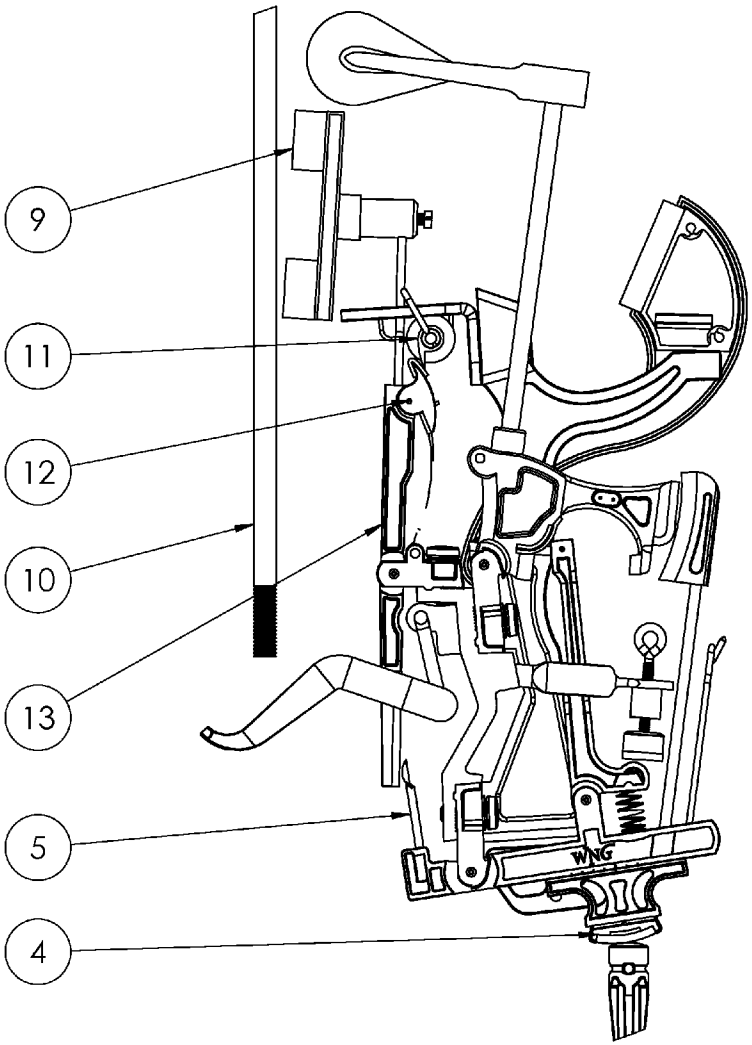
FIG. 14 is a side elevation view of different piano key, piano action, damper action, and piano string of the same piano as FIG. 13, with its key fully depressed after holding down the sostenuto pedal, where the lack of interference between longitudinal ridge and the sostenuto spring tabs can be noted due to the ratchet effect of the sostenuto spring tabs.

Before the returning to the FIG. 10 dampened state, however, the pianist may wish to sustain these already depressed notes and then move on to playing other notes without such sustain. FIGS. 12-14 depict this state of affairs.

Figure 15:
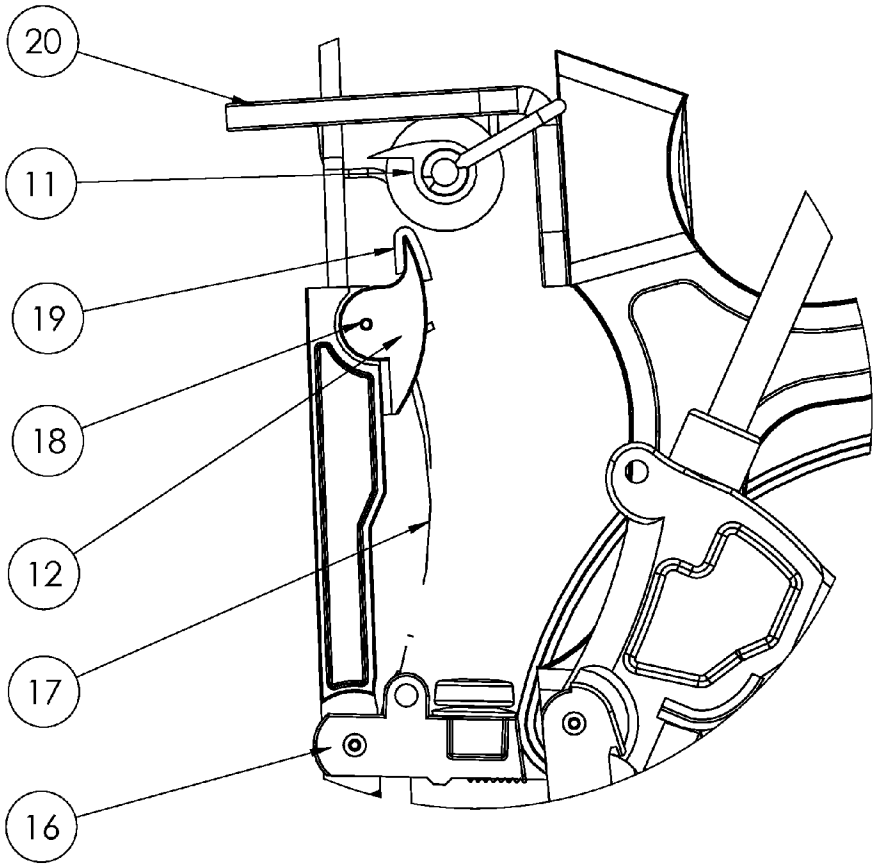
FIG. 15 is a blow-up view of a damper action for an upright piano with sostenuto spring tab.

FIG. 12 depicts the rotation of sostenuto rod 11 in response to depression of the sostenuto pedal. The depression of the sustain pedal causes sostenuto rod 11 to rotate in a counterclockwise direction. The longitudinal axis of sostenuto rod 11 runs perpendicular to the pages of all figures except FIG. 2. Sostenuto lifter rod 11 is a long rod, rail, or track positioned parallel to the piano keyboard running the full width of the piano. Sostenuto rod 11 comprises a longitudinal ridge on the exterior running along the length of the rod. Longitudinal ridge rotates when sostenuto rod 11 rotates. When sostenuto pedal is at rest, longitudinal ridge is positioned as depicted in FIGS. 10-11, and 15, at the nine o'clock location. When sostenuto pedal is fully depressed, longitudinal ridge is positioned as depicted in FIGS. 12-14, at the six o'clock location. As depicted, longitudinal ridge rotates about a quarter turn in response to sostenuto pedal depression.

In FIG. 13, piano key 1 has been released while holding the sostenuto pedal depressed. This cases damper spoon 5 to move in the rightward direction, thereby releasing pressure on the lower end of damper lever 13, causing damper spring 17 to exert pressure on the upper end of damper lever 13 in the counterclockwise direction. Normally this would return damper 9 to rest upon piano string 10. However, damper 9 does not return to rest upon piano string 10 because of the pressure exerted on the sostenuto pedal, translating to pressure on sostenuto spring tab 12. Damper 9 would return but for sostenuto spring tab 12 snared against the longitudinal ridge of sostenuto rod 11. Thus, the sostenuto pedal actuates the damper action to hold damper 9 away from piano string 10 until the pedal is released.

Referencing FIG. 14, while the sostenuto pedal is depressed and longitudinal ridge is at the six o'clock position, when new piano keys 1 or new piano notes are played, the piano action still actuates the damper action. Thus, damper spoon 5 moves leftward to contact the lower end of damper lever 13, to rotate the member, causing rigid tab 15 to threaten a collision with these members. However, with the design of the sostenuto spring tab 12, tab 12 breaks away to rotate in the counterclockwise direction, thereby avoiding the collision. Spring tab 12 is merely pushed aside rather than crashed into. This eliminates all unwanted sounds created with upright pianos of the prior art.

Referencing FIG. 15, spring tab 12 is a rocker member with center of rotation at point 18. Spring tab 12 is a cylindrical member with a longitudinal ridge running down two opposite sides of the member. One longitudinal ridge is used to catch onto the longitudinal ridge of the sostenuto rod 11. The other is used to catch on a ridge of the damper lever 13 to prevent rotation in the clockwise direction. Center-of-rotation 18 runs along the center axis of the member. Spring tab 12 is positioned on the upper end of damper lever 13 in such a way as to limit spring tab 12 rotation in the clockwise direction but allow slight rotation in the counterclockwise direction. This is accomplished by spring tab 12 meeting resistance from the damper lever 13 in one direction but not so in the other.

Still referencing FIG. 15, damper spring 17 is semirigid oblong spring member as depicted that holds damper lever 13 firmly against piano string 10. Damper spring 17 also holds spring tab 12 firmly in the clockwise direction against the damper lever 13 by pressing on the exterior of one of its longitudinal ridges. Spring tab 17 is a low tension spring so that the pressure required to depress a piano key 1 should easily overtake that required to bend spring.

Because of the ratcheted or one-way break away design of the sostenuto spring tab 12, the longitudinal ridge of sostenuto rod can hold tight onto sostenuto spring tab 12 in the clockwise direction but allow the spring tab 12 to freely pass in the counterclockwise direction.

What is claimed:

1. A damper action for an upright piano comprising: a damper lever; a damper spring; a damper wire; a damper; and a sostenuto spring tab, wherein, said damper lever is a rigid oblong member with an upper and lower end, said damper wire is a rigid oblong member with an upper and lower end, said lower end of said damper wire is rigidly connected in series to said upper end of said damper lever to form a longer rigid oblong member, said damper is rigidly connected to said upper end of said damper wire, said sostenuto spring tab is a cylindrical member with a longitudinal ridge running down two opposite sides of the cylindrical member, said sostenuto spring tab is pivotally connected to the upper end of said damper lever so that said sostenuto spring tab rotates freely in one direction around the longitudinal axis of its cylindrical shape by overcoming a spring tension of said damper spring but does not rotate in the other direction because of an obstruction between one said longitudinal ridge of said sostenuto spring tab and a recessed mounting hold of said damper lever, and said damper spring applies tension to one said longitudinal ridge to firmly hold said longitudinal ridge against a surface of said damper lever, which, in turn, applies tension to the upper end of said damper lever to hold said damper against a piano string.

* * * * *